United States Patent [19]

Dantlgraber et al.

[11] 4,310,290

[45] Jan. 12, 1982

[54] RADIAL PISTON PUMP

[75] Inventors: Jörg Dantlgraber, Lohr am Main; Dietmar Gössl, Gössenheim; Horst Kramer, Lohr, all of Fed. Rep. of Germany

[73] Assignee: G. L. Rexroth GmbH, Lohr, Fed. Rep. of Germany

[21] Appl. No.: 894,018

[22] Filed: Apr. 5, 1978

[30] Foreign Application Priority Data

Apr. 16, 1977 [DE] Fed. Rep. of Germany ..... 2716888

[51] Int. Cl.[3] ..... F04B 1/14

[52] U.S. Cl. ..... 417/273; 417/464

[58] Field of Search ..... 417/273, 464; 92/119

[56] References Cited

U.S. PATENT DOCUMENTS

| | | | |
|---|---|---|---|
| 2,450,248 | 9/1948 | Morgan et al. | 417/273 |
| 3,412,647 | 11/1968 | Paschke | 91/491 |
| 3,682,572 | 8/1972 | Yarger | 417/273 |

FOREIGN PATENT DOCUMENTS

| | | | |
|---|---|---|---|
| 1925306 | 11/1970 | Fed. Rep. of Germany | 417/273 |
| 2243138 | 3/1974 | Fed. Rep. of Germany | 417/273 |
| 2331463 | 1/1975 | Fed. Rep. of Germany | 417/273 |
| 1246647 | 9/1971 | United Kingdom | 417/464 |
| 1429497 | 3/1976 | United Kingdom | 417/273 |

*Primary Examiner*—William L. Freeh

*Attorney, Agent, or Firm*—Michael J. Striker

[57] ABSTRACT

A radial piston pump has a housing bounding a suction chamber therein and provided with a plurality of pressure ports spaced from one another in circumferential direction of this housing, and with at least one suction port. A plurality of valve units spaced from one another in the circumferential direction of this housing are provided, each of which includes a pressure valve element located in a respective one of the pressure ports and a sleeve member mounted in the same pressure port radially outwardly of the pressure valve element so as to form, together with the latter, a pressure chamber inwardly of and communicating with the pressure port. A plurality of circumferentially extending channels are formed in this housing and intersect the respective pressure chambers.

9 Claims, 3 Drawing Figures

A1

RADIAL PISTON PUMP

BACKGROUND OF THE INVENTION

The present invention relates to a radial piston pump.

More particularly, it relates to a radial piston pump having a housing, a plurality of wall units spaced from one another in the circumferential direction of this housing, and a channel communicating with the pressure side of the valve units with one another.

Radial piston pumps having a channel communicating the pressure sides of pressure valve units have been proposed in the art. In the known radial piston pumps the channel is formed by a circular groove provided in the region of the pressure valves and associated with an annular member surrounding the groove from outside. In order to provide for a sealing engagement between the annular member and a pump housing sealing means must be arranged between the annular member and the pump housing at both sides of the circular groove, respectively. The pressure port extends thereby between neighboring pump elements parallel to an axis of the pump outwardly, and it communicates with the circular groove in the housing circumference through a radial bore. The thus-formed channel which communicates the pressure sides of the pressure valve in connection with the pressure port requires a very expensive construction, it is not suitable for producing a compact pump, and it does not guarantee simple interchangeability of the pressure valve. In order to replace a valve it is necessary to remove the annular member surrounding the circular groove, that requires fully dismounting of the pump.

SUMMARY OF THE INVENTION

Accordingly, it is an object of the present invention to provide a radial piston pump which avoids the disadvantages of the prior art.

More particularly, it is an object of the present invention to provide a radial piston pump which is convenient for maintenance and has a compact construction, as well as is quiet in operation and has small dimensions in connection with an economical manufacture and support, wherein individual elements of the pump are limited to a minimum number and have identical dimensions, except of the cases when the housings are provided for various numbers of pump elements.

In keeping with these objects and with others which will become apparent hereinafter, one feature of the present invention, briefly stated, resides in a radial piston pump having a housing bounding a suction chamber and provided with a plurality of pressure ports spaced from one another in circumferential direction of the housing, and with at least one suction port, a plurality of valve units spaced from one another in the circumferential direction of the housing and each including a pressure valve element and a sleeve member located in a respective one of the pressure ports and spaced from one another so as to form a pressure chamber therebetween, wherein means communicating the pressure chambers with each other includes a plurality of circumferentially extending channels in the housing and intersecting the respective pressure chambers.

When a radial piston pump is constructed in accordance with the present invention, it has a compact construction and is convenient in maintenance, and at the same time assures a quiet operation and small dimensions which are highly economical with respect to its manufacture and support. At the same time such a radial piston pump has the minimum number of individual elements which have identical dimensions.

The housing of the piston pump may have a body portion having an opening and a cover portion detachably closing this opening, whereas the ports and the valve units are provided in the body portion of the housing. Both the body portion and the cover portion may be castings. The ports extend in radial direction of the housing, and the channels communicating with the pressure chambers are cast-produced channels. Another feature of the present invention is that the channels communicating the pressure chambers with one another lie in a common plane in which axes of the pressure valve elements are located.

Still another feature of the present invention is that each of the pressure valve elements sealingly abuts against one of cylindrical members provided in a respective one of piston units and mounted on a respective piston. The pressure valve element abuts against the cylindrical member over an annular sealing surface which has a diameter smaller than a diameter of a respective one of the pressure ports in which the pressure valve element is located.

A further feature of the present invention is that the radial piston pump comprises resilient means located between each of the pressure valve elements and a respective one of the sleeve members so as to urge the former into a predetermined position or, in other words, into abutment against the housing.

A still further feature of the present invention is that a shaft operative for moving the pistons so that the latter performs suction strokes and pressure strokes, extends through the body part of the housing outwardly of this body part.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawing.

DESCRIPTION OF A PREFERRED EMBODIMENT

Figure 1:
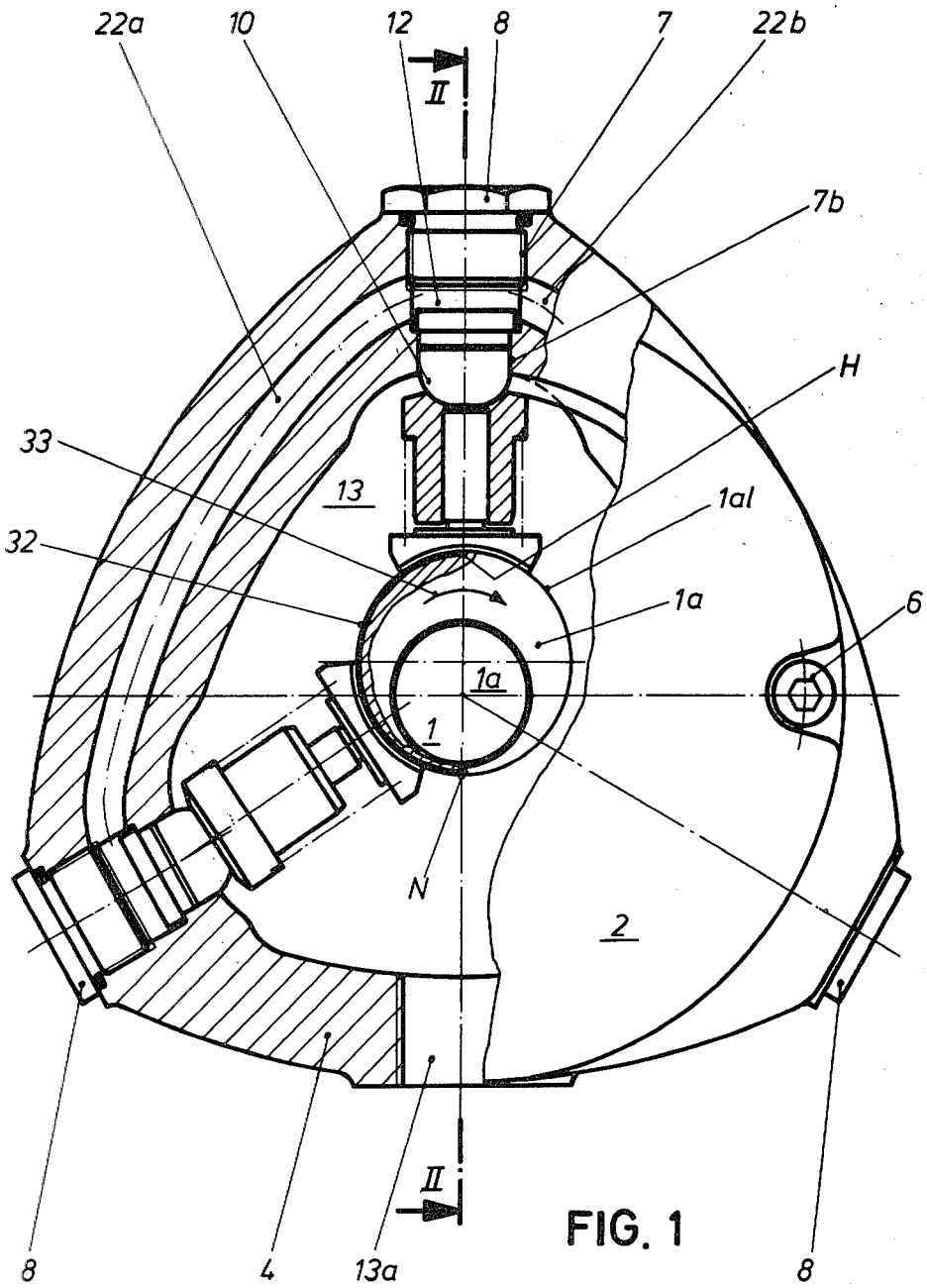
FIG. 1 is a partially sectioned plan view of a radial piston pump in accordance with the present invention.
Figure 2:
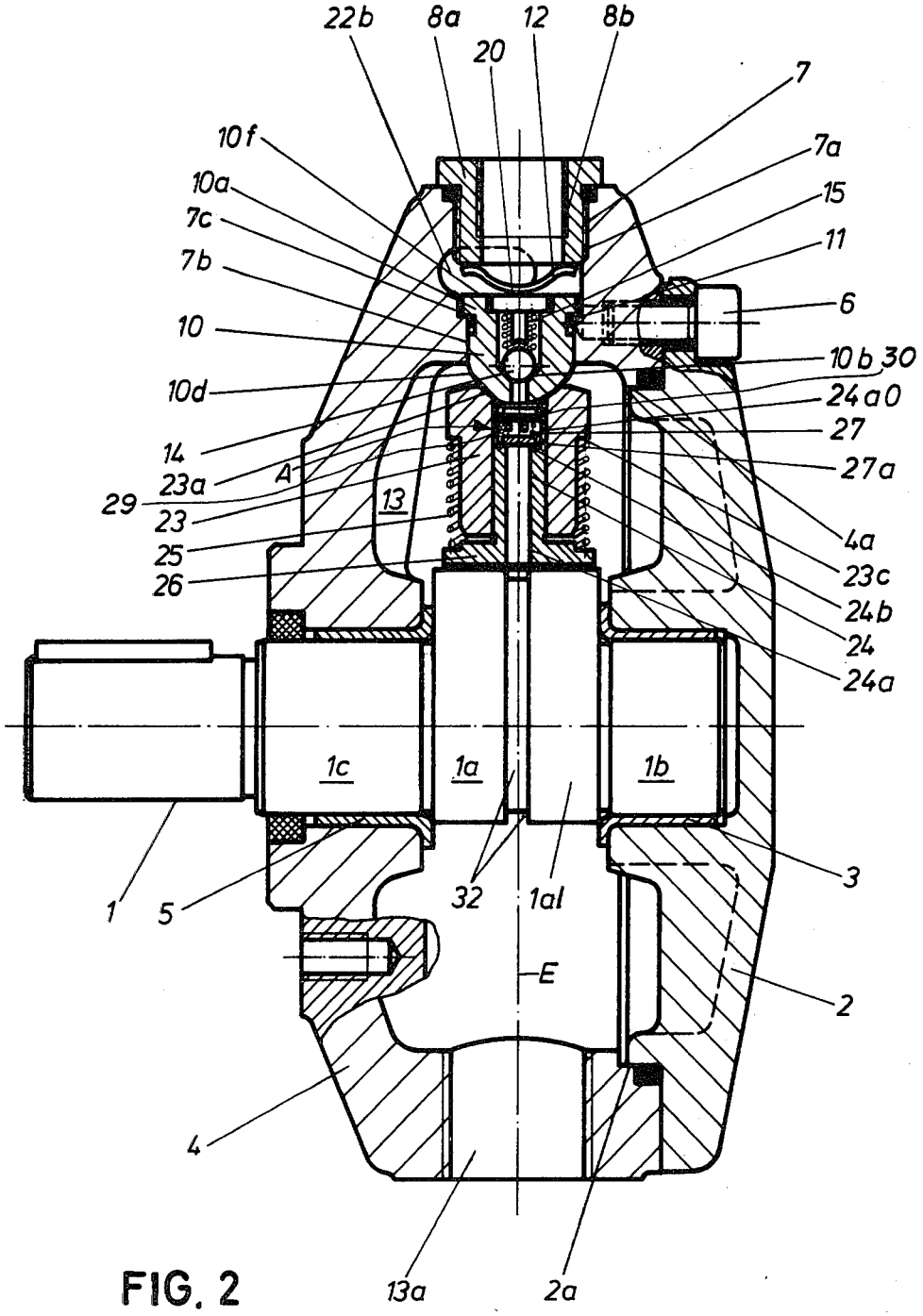
FIG. 2 is a partially sectioned view on the line II—II in FIG. 1.

FIG. 1 shows a radial piston pump in accordance with the present invention wherein a pump shaft is identified by reference numeral 1 and has an eccentric identified by reference numeral 1*a*. The shaft 1 extends through a housing of the pump outwardly thereof. One end portion 1*b* of the pump shaft 1 is received in a bushing 3 which is mounted in a cover 2 of the housing 4 of the pump. An opposite end portion 1*c* of the pump shaft 1 is received in a bushing 5 which is mounted directly in the housing 4 of the pump. The housing 4 and the cover 2 are castings, and the cover 2 has an annular bearing surface 2*a* which is received in a recess 4*a* of the pump housing 4. The cover 2 is secured to the housing 4 by means of bolts 6.

Three radial bores 7 are provided in the housing 4 and uniformly distributed over a circumferential surface thereof. An outer portion 7*a* of each bore 7 has an inner thread for screwing a locking screw 8 or a radially outwardly extending threaded sleeve member 8*a*. An inner portion 7*b* of each bore 7 has a diameter smaller than the diameter of the outer portion 7*a* and forms a bearing surface for a body 10 of a pressure valve. The pressure valve body 10 has a flange 10*a* which abuts against a surface 7*c* and thereby secures the pressure valve body 10 against an axial displacement. A resilient element 20 such as a spring, urges the pressure valve body 10 toward the surface 7*c* so that the pressure valve body 10 is secured against movement in the axial direction. A sealing ring 11 assures sealing of a pressure chamber 12 formed at the pressure side of the pressure valve bodies from an inner chamber of the housing forming a suction chamber 13 of the pump. The housing 4 of the pump has a throughgoing suction port 13*a* communicating with the inner chamber 13.

A valve member of the pressure valve body 10 is formed by a ball 14 which is urged by a weak spring 15 toward a valve seat 10*b*.

The pressure chambers 12 formed between the pressure valve bodies 10 and the locking screws 8 or the threaded sleeve 8*a* forming pressure connection, communicate with one another by channels 22*a* and 22*b* which are formed in this housing and extend in the circumferential direction thereof so as to intersect the respective pressure chambers. More particularly, the channels 22*a* and 22*b* intersect gaps formed between the surfaces 10*f* of the pressure valve bodies 10 and the locking screws 8 or the threaded sleeves 8*a*. The channels 22*a* and 22*b* are cast-produced in this housing. The channels 22*a* and 22*b* lie in a plane in which the axes of the pressure valve bodies 10 are located. The threaded sleeve 8*a* has an inner thread 8*c* for connection with a not-shown pressure conduit.

An end portion 10*d* of the pressure valve body 10 which faces toward the inner chamber 13 of the housing 4 is ball-shaped. A sealing surface 23*a* of a cylindrical member 23 sealingly abuts against the ball-shaped end portion 10*d* of the pressure valve body 10. A lower edge portion of the sealing surface 23*a* is smaller than the diameter of a portion of a cylinder bore 23*b* in which a piston 24 is received. At the same time, it is smaller than the diameter of the inner portion 7*b* of the radial bore 7 for the pressure valve body 10. This assures that during the working stroke of the piston 24 the sealing surface 23*a* of the cylindrical member 23 will sealingly abut against the ball-shaped portion 10*d* of the pressure valve body 10. This also assures that the pressure valve body 10, in addition to the force of the resilient member 20, is also urged by the pressure built in the pressure chamber 12 so that its flange 10*a* abuts against the surface 7*c* of the stepped bore 7, and therefore the valve body member 10 is secured in the predetermined axial position. Furthermore, the cylindrical member 23 is urged into abutment against the ball-shaped end portion 10*d* of the pressure valve body 10 under the action of the spring 25, so that also during the suction stroke of the pistons 24 the sealing surface 23 sealingly abuts against the ball-shaped end portion 10*d* of the pressure valve body 10.

Figure 3:
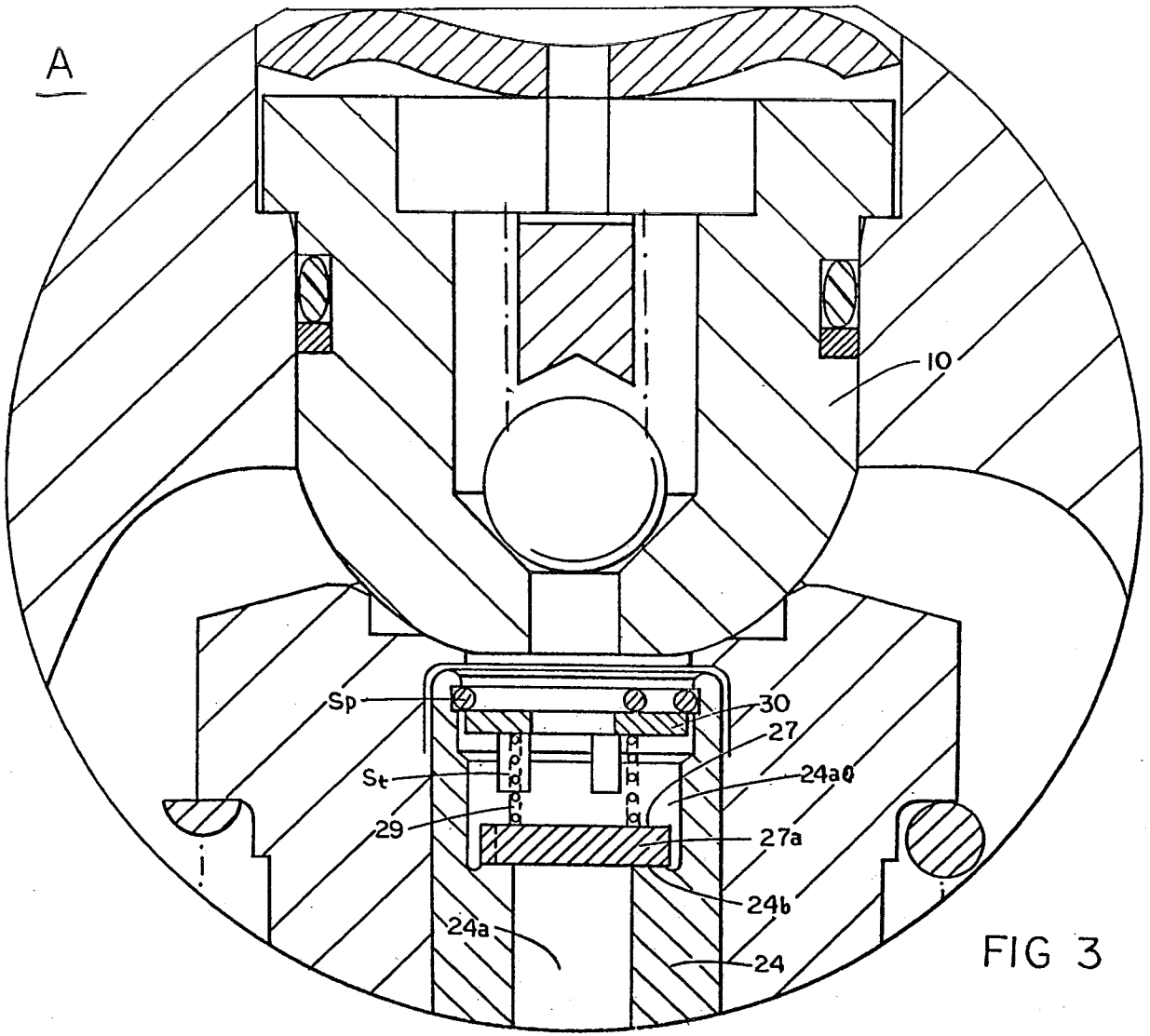
FIG. 3 is an enlarged view of the area A in FIG. 2.

The spring 25 abuts with its one end against a sliding member 26 which is one piece with the piston 24, and abuts with its other end against a projecting surface 23*c* of the cylindrical member 23. The piston is provided with an axial passage 24*a*. An upper portion 24*a*O of this passage has a diameter which is larger than the diameter of the remainder of the axial passage 24*a*. Elements forming a valve seat 24*b*, a plate-like locking member 27*a*, a spring 29, and a supporting spring ring 30 which is mounted in forced relationship with the piston, are provided. These elements together form a suction valve 27 as shown in particular in FIG. 3.

The locking member 27*a* of the suction valve 27 is urged by the spring 29 against the valve seat 24*b*. The other end of the spring abuts against the spring ring 30 which in turn abuts against an expansion ring $S_p$. The spring ring 30 has projections $S_t$ against which the locking member 27*a* abuts in its open position. Thereby, it is prevented that the spring 29 be completely compressed and the overflow of the sucked-in fluid in the released cylindrical space be eliminated.

The axial passage 24*a* extends simultaneously through the sliding member 26 and is in operative communication with a groove 32 provided in a contact surface 1*a*1 of the eccentric 1*a*. The groove 32 extends from the highest reversal point H to the lowest reversal point N of the eccentric 1*a*. Only during the suction stroke of the piston the contact surface of the eccentric is decreased by the groove 32 which forms a communication between the inner chamber of the housing 4 forming the suction chamber 13, and the passage 24*a* of the piston. During the subsequent working or pressure stroke of the piston the entire contact surface 1*a*1 of the eccentric 1*a* is available for transmission of the operative force to the piston 24 through the sliding flange 26.

It will be understood that each of the elements described above, or two or more together, may also find a useful application in other types of constructions differing from the types described above.

While the invention has been illustrated and described as embodied in a radial piston pump, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A radial piston pump, comprising a housing bounding a suction chamber therein and having an axis, said housing being provided with a plurality of pressure ports spaced from one another in a circumferential direction of said housing, and with at least one suction port; a plurality of valve units spaced from one another in the circumferential direction of said housing, each of said valve units including a pressure valve element located in a respective one of said pressure ports and performing the functions of controlling flow of a working fluid, and a separate threaded sleeve-shaped closure member mounted in the same pressure port radially outwardly of said pressure valve element and performing only the function of closing the same pressure port from outside and passing a pressure medium therethrough, so that a pressure chamber is formed radially between the pressure valve element and the separate closure member inwardly of and communicating with the pressure port; means communicating said pressure chambers with each other, including a plurality of channels which extend only circumferentially in said housing and intersect the respective pressure chambers formed between the respective pressure valve elements and the separate closure members; and a plurality of piston units spaced from one another in the circumferential direction of said housing and each having a piston and a cylindrical member connected therewith, each of said pressure valve elements sealingly abutting against a respective one of said cylindrical members of said piston units over an annular sealing surface which has a diameter smaller than a diameter of a respective one of said pressure ports in which said pressure valve element is located.

2. The radial piston pump as defined in claim 1, wherein said ports extend in radial directions of said housing.

3. The radial piston pump as defined in claim 1, wherein said channels are cast-produced channels.

4. The radial piston pump as defined in claim 1, wherein said pressure valve elements have axes located in a common plane, said channels lying in said common plane of said axes.

5. The radial piston pump as defined in claim 1, wherein said housing has a body portion having an opening and a cover portion detachably closing said opening, said ports and said valve units being provided in said body portion of said housing.

6. The radial piston pump as defined in claim 5, wherein said body portion and said cover portion are castings.

7. The radial piston pump as defined in claim 5, wherein said piston is movable so as to perform suction strokes and pressure strokes; and further comprising a shaft operative for moving said pistons and extending through said body part of said housing outwardly thereof.

8. The radial piston pump as defined in claim 1; and further comprising resilient means located between each of said pressure valve elements and a respective one of said closure members so as to urge the former into a predetermined position.

9. The radial piston pump as defined in claim 8, wherein said pressure valve element is movable relative to said housing and adapted to abut against the latter in said predetermined position under the action of said resilient means.

* * * * *